US005809695A

United States Patent [19]

Strickland

[11] Patent Number: 5,809,695

[45] **Date of Patent: *Sep. 22, 1998**

[54] WINDOW REGULATOR

[75] Inventor: Thomas J. Strickland, Troy, Mich.

[73] Assignee: Hi-Lex Corporation, Battle Creek, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 788,325

[22] Filed: Jan. 27, 1997

[51] Int. Cl.[6] ..... E05F 11/48

[52] U.S. Cl. ..... 49/352

[58] Field of Search ..... 49/375, 352, 349, 49/348, 374

[56] References Cited

U.S. PATENT DOCUMENTS

| | | | |
|---|---|---|---|
| 4,237,657 | 12/1980 | Kazewych | 49/375 X |
| 4,631,864 | 12/1986 | Barros | 49/352 |
| 4,700,508 | 10/1987 | Kollner et al. | 49/352 |
| 4,706,412 | 11/1987 | Kobrehel | 49/352 |
| 4,991,351 | 2/1991 | Bertolini | 49/351 |
| 5,009,035 | 4/1991 | Kuki et al. | 49/352 |
| 5,333,411 | 8/1994 | Tschirschwitz et al. | 49/352 |
| 5,398,449 | 3/1995 | Kobrehel et al. | 49/352 |
| 5,469,663 | 11/1995 | TenBrink et al. | 49/352 X |
| 5,513,468 | 5/1996 | Diestelmeier | 49/375 |
| 5,515,651 | 5/1996 | Hofmann et al. | 49/375 |

OTHER PUBLICATIONS

GMT800. DOC TS/MD Benchmarking Study, 4 sheets (pp. 1–4).

*Primary Examiner*—Jerry Redman
*Attorney, Agent, or Firm*—Young & Basile P.C.

[57] ABSTRACT

A window regulator for raising and lowering a window glass in a motor vehicle. The regulator includes left and right guide rails, left and right window glass carriers slidably mounted on the rails and mounted on the lower edge of the glass, pulleys mounted on the rails, a motor and drum assembly mounted within the door, and cable assemblies suitably trained around the pulleys, secured to the carriers, and wrapped around the drum so that energization of the motor has the effect of raising and lowering the glass. Each window glass carrier includes a slide mounted on the rail and a clamp secured to the lower edge of the window glass. The slide and clamp are coupled together in response to lateral movement of the slide relative to the clamp to snapingly couple the slide and clamp together. The slide member coacts with the clamp in one of the window glass carriers to provide a significant amount of lateral movement between the coupled slide and clamp to allow the regulator to compensate for other than precise parallelism between the first and second rails. The same slide member, rotated with respect to its position in the one window glass carrier, snapingly coacts with the clamp assembly of the other window glass carrier to provide a relatively rigid interconnection therebetween.

13 Claims, 4 Drawing Sheets

WINDOW REGULATOR

BACKGROUND OF THE INVENTION

This invention relates to window regulators and more particularly to window regulators for use in raising and lowering window glasses in motor vehicles.

Motor vehicles include a plurality of window glasses and a corresponding plurality of window regulators to raise and lower the window glasses either manually or with a power assist. Whereas a myriad of window regulators have been proposed and/or utilized in raising and lowering the windows of motor vehicles, each of the prior art devices has suffered from one or more disadvantages.

Specifically, the prior art regulators have either been very complicated, relatively maintenance prone, relatively heavy, relatively large, and/or relatively erratic in operation.

The complicated construction adds to the cost of manufacture and assembly and thereby adds to the ever increasing cost of the associated motor vehicle; the maintenance problems exacerbate the problems of motor vehicle ownership; the relatively heavy aspect adds to the weight of the vehicle and thereby lowers the gas mileage of the vehicle; the relatively large aspect complicates the use of the regulator in the evermore narrow profiles of the doors of modern day motor vehicles; and the relatively erratic operation is annoying and inconvenient.

SUMMARY OF THE INVENTION

This invention is directed to an improved window regulator especially suitable for motor vehicular use.

More particularly, this invention is directed to a window regulator that is simple in construction, inexpensive to manufacture and assemble, reliable and smooth in operation, lightweight, and compact.

The window regulator of the invention is adapted to raise and lower the window glass of a motor vehicle and includes a vertical rail defining a vertical track, a glass carrier adapted to receive a lower edge of the window glass and mounted for vertical movement along the track to raise and lower the window glass, and a drum and cable assembly operative to move the glass carrier vertically along the track.

According to the invention, the glass carrier comprises a slide mounted for sliding movement along the rail; a clamp adapted to clampingly engage a lower edge of the window glass; and coupling means operative in response to lateral movement of the slide relative to the clamp to snapingly couple the slide and clamp together to form the glass carrier. This specific coupling arrangement reduces the assembly cost of the carrier and thereby the overall cost of the regulator.

According to a further feature of the invention, the vertical rail comprises a first vertical rail; the window regulator further includes a second vertical rail mounted in laterally spaced relation to the first vertical rail, the glass carrier comprises a first glass carrier including a first slide mounted on the first rail and coupled to a first clamp; the window regulator further includes a second glass carrier including a second slide mounted on the second rail and coupled to a second clamp; and the coupling means of the first glass carrier is operative to provide a significant amount of lateral movement between the coupled slide and clamp. This arrangement allows the regulator to hunt laterally to compensate for other than precise parallelism between the first and second rails.

According to a further feature of the invention, the coupling means of the second glass carrier is operative to snapingly couple the slide and clamp together with an insignificant amount of lateral movement permitted between the slide and clamp. This arrangement provides a positive interengagement as between the second glass carrier and the glass to avoid promiscuous lateral displacement of the glass relative to the regulator while the lateral play provided by the first glass carrier allows the regulator to hunt laterally to compensate for lack of parallelism between the rails.

According to a further feature of the invention, each coupling means comprises a vertically extending prong structure on the slide and laterally spaced lock structures on the associated clamp operative in response to lateral coupling movement between the slide and associated clamp to trap the prong structure between the lock structures. This specific coupling arrangement provides a simple and efficient means of providing the coupling in a snapping manner.

According to a further feature of the invention, the prong structure of each slide comprises a first relatively flexible prong structure; each slide further includes a second relatively inflexible vertically extending prong structure; the first relatively flexible prong structure of the first slide coacts with the lock structures on the first clamp to permit the significant amount of lateral movement between the slide and clamp; and the second relatively inflexible prong structure of the second slide coacts with the lock structures on the second clamp to provide the insignificant amount of lateral movement between the slide and the clamp. This arrangement allows the same slide to be used in the first glass carrier to provide the desired lateral play in the carrier and be used in the second glass carrier to provide the desired rigidity as between the slide and clamp of the second carrier.

According to a further feature of the invention, the clamp includes a laterally extending blade, the slide includes a slot sized to slidably receive the blade in response to lateral coupling movement between the slide and clamp, the slot includes a side opening in a lateral edge of the slide to receive the leading edge of the blade and further includes a front opening in a front face of the slide; the prong structure extends vertically and in cantilever fashion into the front opening, the lock structures are provided on a front face of the blade and include a leading lock structure and a trailing lock structure, and the leading lock structure acts in response to lateral sliding movement of the blade into the slot to bias the prong structure forwardly and thereafter allow the prong structure to snap into place between the leading and trailing lock structures. This specific coupling arrangement provides a simple, effective, and inexpensive means of providing the desired coupling action as between the slide and the clamp.

In the disclosed embodiment of the invention, the front opening of the slot defines a lower edge and an upper edge; the prong structure comprises a first prong structure that is relatively flexible in a lateral sense and extends vertically from one of the upper and lower edges; the first prong structure is cooperable with the lock structures to permit a significant amount of lateral movement between the coupled slide and clamp; the slide further includes a second prong structure which is relatively inflexible in a lateral sense and extends vertically from the other of the upper and lower edges; and the second prong structure is cooperable with the lock structures to permit an insignificant amount of lateral movement between the coupled slide and clamp. This specific construction allows the same slide to be used to provide lateral play in one of the glass carriers and a lack of lateral play in the other glass carrier.

DETAILED DESCRIPTION OF THE PREFERRED EMBODIMENT

Figure 1:
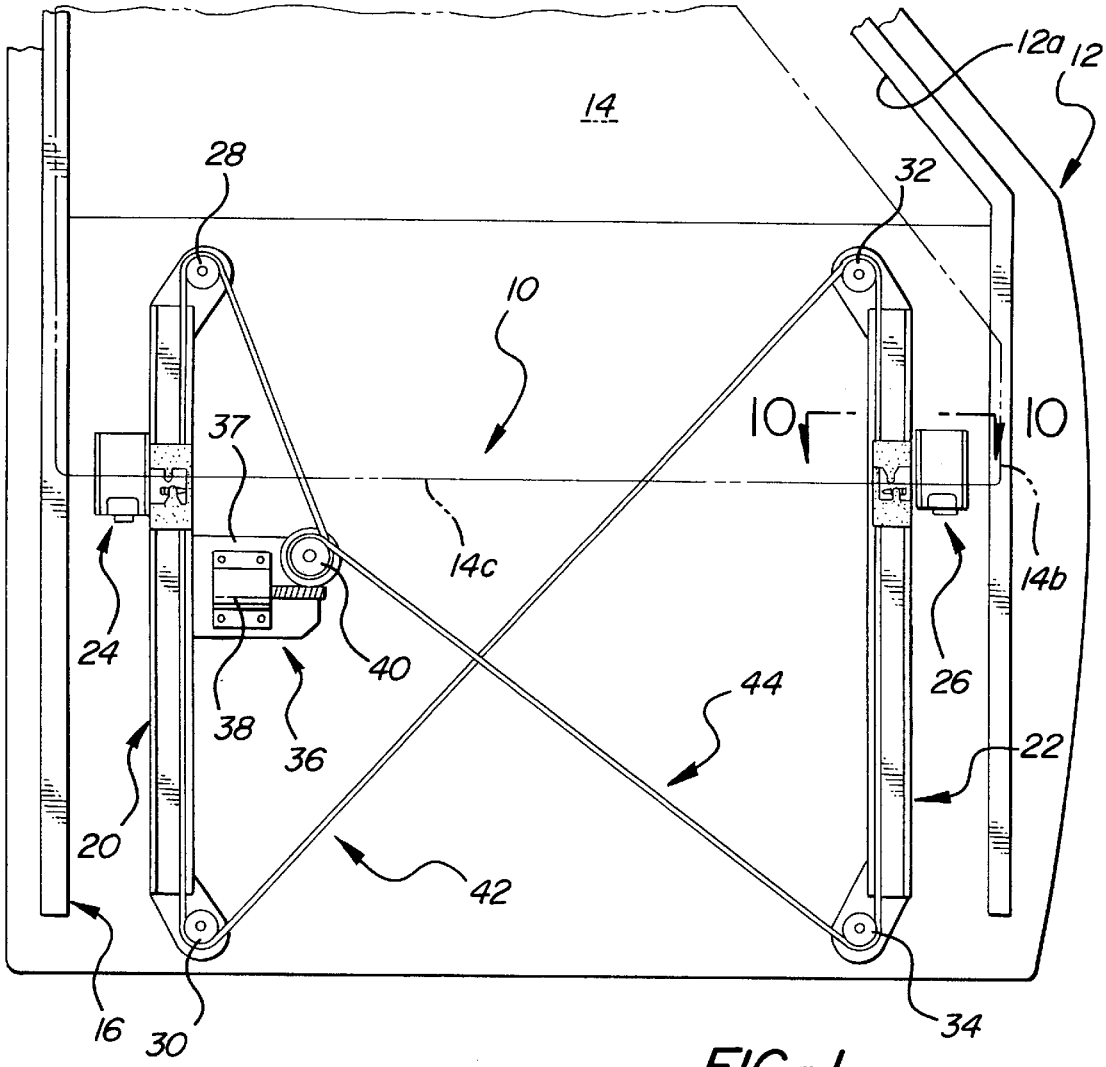
FIG. 1 is a somewhat schematic view of the window regulator of the invention shown in association with a motor vehicle door.

The window regulator 10 of the invention is seen in FIG. 1 in association with a motor vehicle door assembly 12 defining a window opening 12*a* and including a window glass 14 sliding in left and right guide rails 16 and 18 positioned within the hollow of the door.

Window regulator 10 includes left and right rails 20 and 22; left and right window glass carriers 24 and 26 mounted for slidable vertical movement along the respective rails; pulleys 28, 30, 32 and 34 suitably mounted on the upper and lower ends of the rails; a motor and drive assembly 36 mounted on the left rail 20 by bracketry 37 and including a motor 38 driving a drum 40; and first and second cable assemblies 42 and 44.

First cable assembly 42 is secured to the lower end of left window glass carrier 24 and the upper end of right window glass carrier 26 and is trained over pulleys 30 and 32. Second cable assembly 44 is secured to the upper end of left window glass carrier 24 and the lower end of right window glass carrier 26, is trained over pulleys 28 and 34, and wraps around drum 40. It will be seen that energization of motor 38 (or winding of a manual window crank) has the effect of raising and lowering the window glass 14 utilizing left and right window glass carriers 24 and 26 with the right and left side edges 14*a* and 14*b* of the window glass guiding in guide rails 16/18. Cable assemblies 42 and 44 are preferably Bowden cables and include suitable sheathing (not shown) to define the cable paths and guide the movement of the cable along the cable paths.

Figure 10:
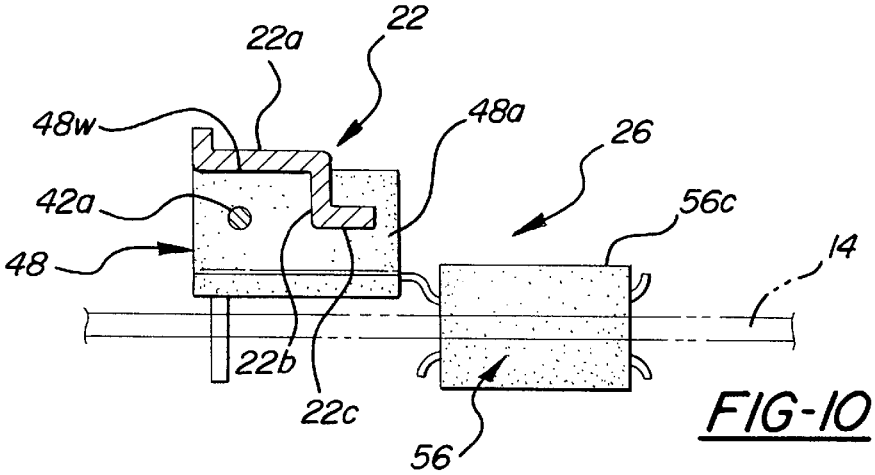
FIG. 10 is a cross-sectional view taken on line 10—10 of FIG. 1.

Right rail 22 (FIG. 10) has a Z configuration in cross-section including a planar main body portion 22*a*, a web portion 22*b*, and a flange portion 22*c*. Left rail 20 similarly has a planar main body portion 20*a*, a web portion 20*b*, and a flange portion 20*c*.

Right window glass carrier 26 includes a slide 48 and a clamp assembly 50.

Figure 2:
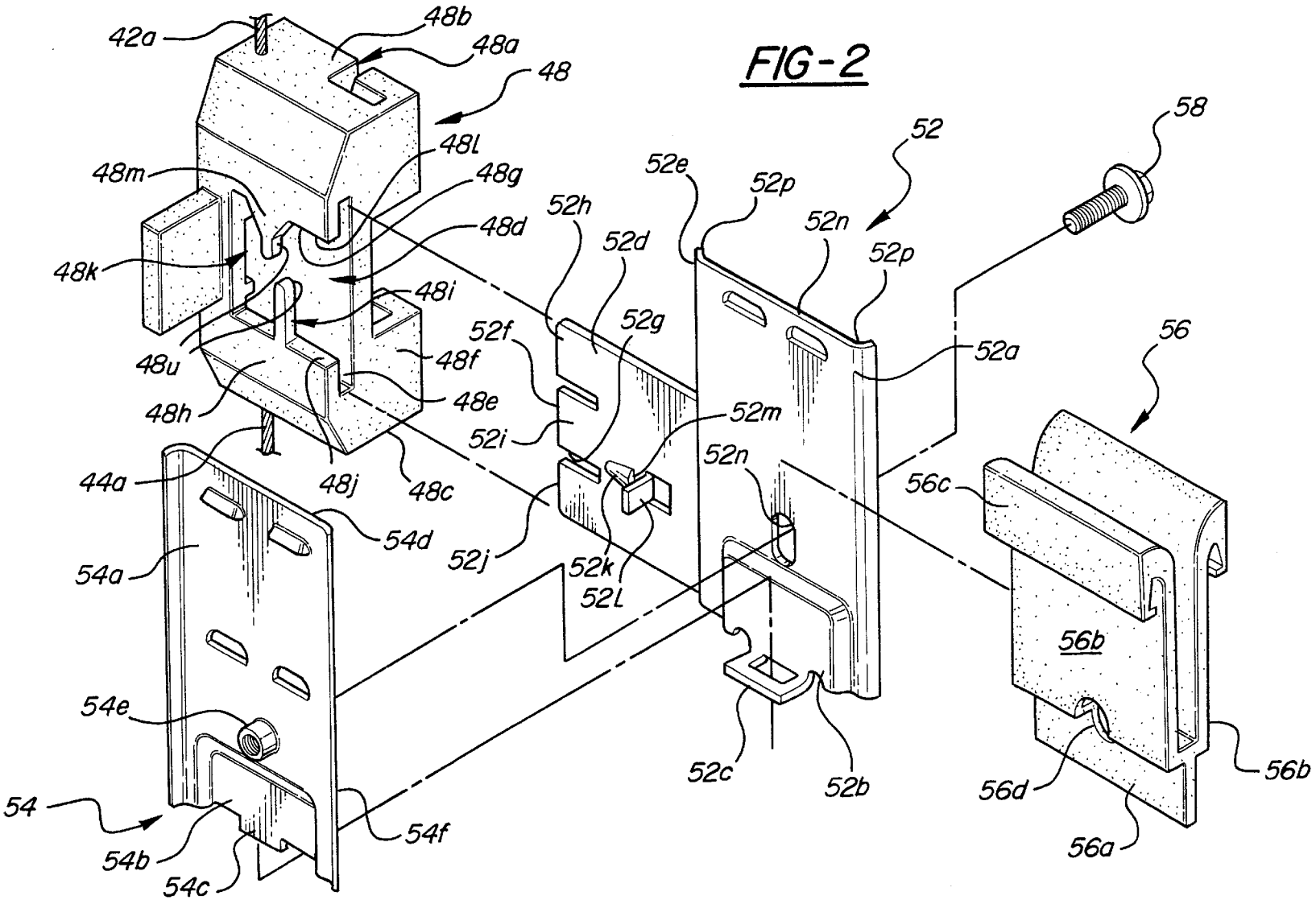
FIGS. 2 and 3 are exploded views of a window glass carrier utilized in the window regulator.
Figure 3:
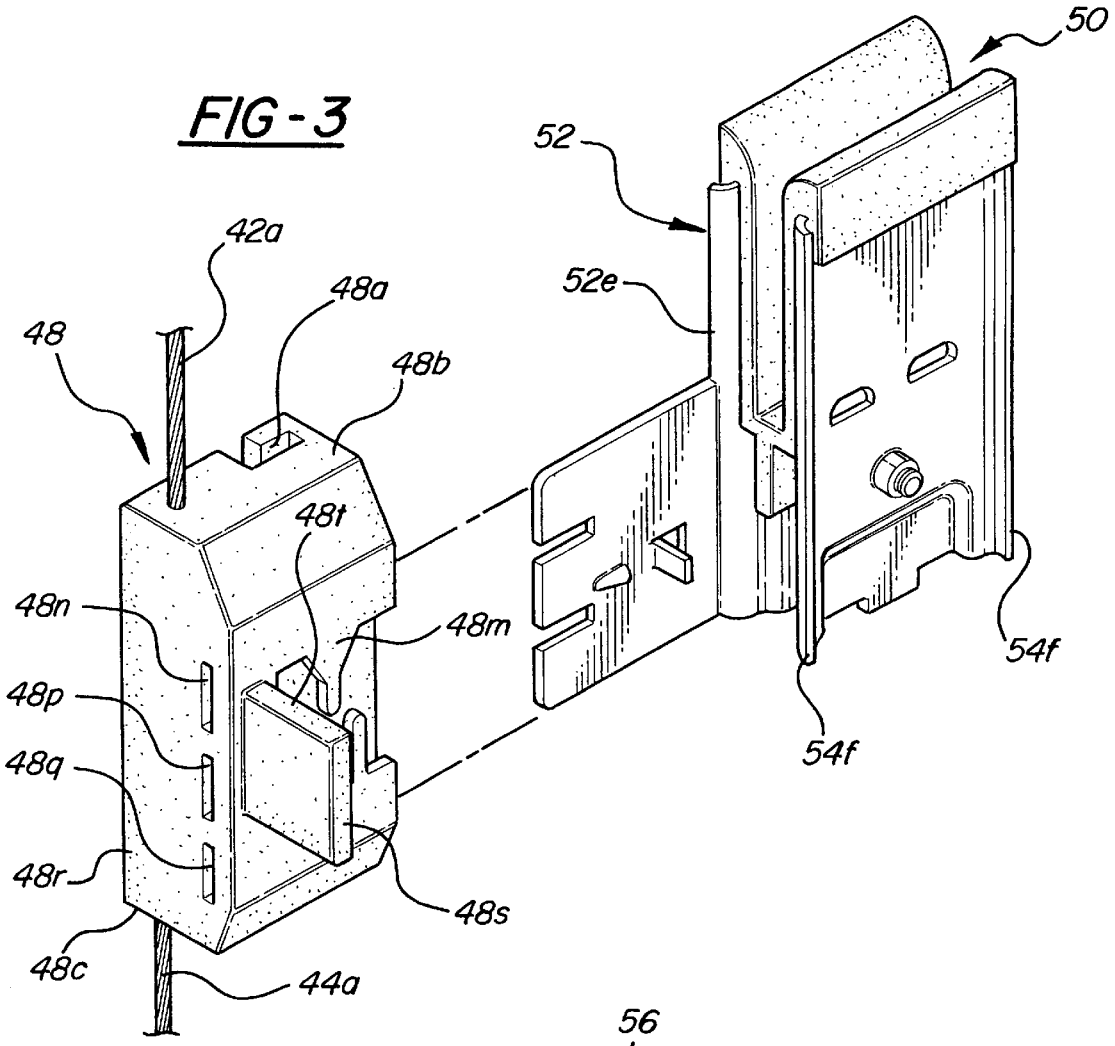

Slide 48 (FIGS. 2 and 3) is formed of a suitable plastic material such, for example, as acetone and has a generally block configuration. An L-shaped guide channel 48*a* is formed in the rear face 48*w* of the slide to slidably accommodate the flange portion 22*c* of rail 22 with the rail main body portion 22*a* positioned slidably against the slide rear face 48*w*. An end 42*a* of cable assembly 42 is suitably secured to the upper face 48*b* of the slide and an end 44*a* of cable assembly 44 is suitably secured to the lower face 48*c* of the slide. Energization of motor 38 will thus have the effect via drum 40 and cable assemblies 42 and 44 of raising and lowering slide 48 along the track defined by rail flange portion 22*c*.

Slide 48 further defines a slot 48*d* including a side opening 48*e* formed in a lateral edge 48*f* of the slide and a front opening 48*g* formed in a front face 48*h* of the slide. Slide 48 further includes a relatively flexible prong structure 48*i* extending vertically upwardly from a lower edge 48*j* of the front opening in cantilever fashion into front opening 48*g* of the slot and a relatively inflexible prong structure 48*k* extending vertically downwardly from an upper edge 48*l* of the front opening in cantilever fashion into front opening 48*g*.

Prong structure 48*i* has a uniform relatively thin cross-sectional configuration so as to provide a significant amount of lateral flexibility and prong structure 48*k* includes a massive triangular base portion 48*m* so as to provide relative inflexibility to the prong structure. The prong structures are also laterally offset with respect to each other.

Slide 48 further includes a plurality of vertically spaced passages 48*n*, 48*p* and 49*q* opening at one end in slot 48*d* and opening at their other end in the other lateral side edge 48*r* of the slide. Slide 48 further includes a forwardly projecting stop portion 48*s* defining an upper edge 48*t* adapted to support the lower edge 14*c* of window glass 14.

Clamp assembly 50 includes a rear clamp 52, a front clamp 54, a liner 56, and a fastener 58.

Front and rear clamps 52 and 54 may comprise ferrous stampings and liner 56 may be formed of a suitable elastomeric material.

Rear clamp 52 includes a generally planar main body portion 52*a*, a raised pad portion 52*b* at the lower end of the main body portion 52*a*, an attachment loop 52*c* extended forwardly from the lower edge of the pad portion 52*b*, and a blade portion 52*d* extending laterally from a side edge 52*e* of the main body portion 52*a*. The free or leading vertical edge 52*f* of blade portion 52*d* includes a pair of vertically spaced slots 52*g* defining a plurality of vertically spaced finger portions 52*h*, 52*i* and 52*j* sized to fit slidably but snugly into respective slide passages 48*n*, 48*p* and 48*q*.

Blade portion 52*d* has a vertical height corresponding generally to the vertical height of slot 48*d* so that the blade may be inserted into the slot to position the finger portions 52*h*, 52*i* and 52*j* in the passages 48*n*, 48*p* and 48*q* and position the main body of the blade within the main body of the slot with the lateral edge 52*e* of the rear clamp positioned proximate the side edge 48*f* of the slide.

Blade portion 52*d* further defines laterally spaced lock structures 52*k* and 52*l*. Lock structure 52*k* is pressed outwardly from the rear face of the blade and has a triangular ramp configuration and lock structure 52*l* is struck from the blade and upstands vertically from the lane of the blade in laterally spaced relation to vertical side edge 52*m* of stop structure 52*k*. Stop structures 52*k* and 52*l* will be seen to be generally horizontally aligned with the upper tip 48*u* of prong structure 48*i*.

Front clamp 54 has a size and configuration generally corresponding to rear clamp 52 but does not include a laterally extending blade portion.

Front clamp 54 includes a main body portion 54*a* of generally planar configuration, a raised lower pad portion 54*b*, and a finger portion 54*c* extending downwardly from pad portion 54*b* for coupling coaction with coupling portion 52*c* of rear clamp 52.

Figure 4:
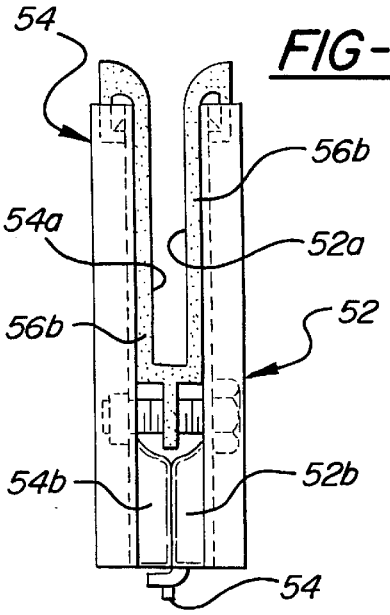
FIGS. 4 and 5 are detail views of a clamp forming a part of the window glass carrier.

Liner 56 (FIGS. 2 and 4) has a bifurcated configuration and includes a lower flange portion 56*a* and spaced upwardly extending liner portions 56*b* terminating in window glass guide portions 56*c*.

In the assembled relation of clamp assembly 50, finger 54*c* is positioned in a slot defined by attachment portion 52*c*; pad portion 52*b* is positioned against pad portion 54*b*; liner 56 is positioned between the front and rear clamps with one liner portion 56*b* confronting the main body portion 52*a* of the rear clamp, one liner portion 56*b* confronting the main body portion 54*a* of the front clamp, and liner guide portions 56*c* looped over the top edges 52*n* and 54*d* of the clamps; and fastener 58 passes through an oblong aperture 52*p* in rear clamp 52, through a hole 56*d* in flange portion 56*a* of the liner, and threadably engages threaded hub 54*e* formed on the front face of the main body portion 54*a* of the front clamp so that rotation of fastener 58 has the effect of bringing elements 52, 56 and 54 together in a clamping fashion. When thus assembled, edge flanges 52*p* at the opposite sides of the main body portion of rear clamp 52 coact to provide a protective envelope containing the head of fastener 58 and edge flanges 54*f* on the opposite sides of the main body portion of front clamp 54 provide a protective envelope containing the hub 54*e* and the projecting tip of fastener 58.

Figure 7:
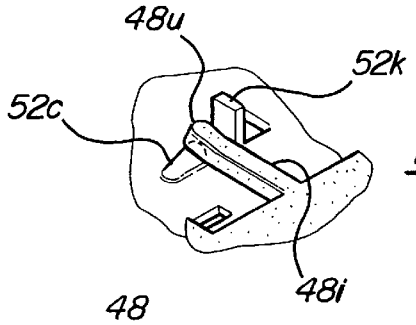
FIGS. 7, 8 and 9 are detail views of a coupling arrangement employed in the window glass carriers.
Figure 9:
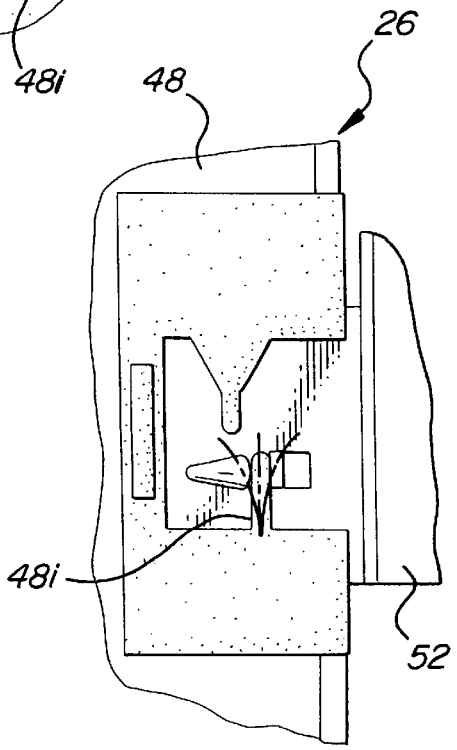

In the assembled relation of right window glass carrier 26, blade 52*d* is inserted into slot 48*d* to move fingers 58*f*, 58*g* and 58*h* into passages 48*n*, 48*p* and 48*q* and to position the main body of the blade within the main body of slot 48*d*. As the leading edge 52*f* of the blade enters the slot and moves into the slot, the leading lock member 52*k* engages prong 48*i* in a ramping action (FIG. 7) to raise the prong 48*i* and allow the prong to pass over the lock structure 52*k* and, with further inserting movement of the blade, snap into position between the lock structures 52*k* and 52*l*. Lock members 52*k* and 52*l* in coaction with prong 48*i* will be seen to comprise coupling means operative in response in generally horizontal movement of the slide relative to the clamp to snappingly couple the slide and the clamp together to form the glass carrier. It will be understood, as best seen in FIG. 9, that prong structure 48*i* by virtue of its constant thin cross-section and its cantilever arrangement, may flex in either direction to provide a significant amount of lateral movement between the coupled slide and clamp.

Figure 5:
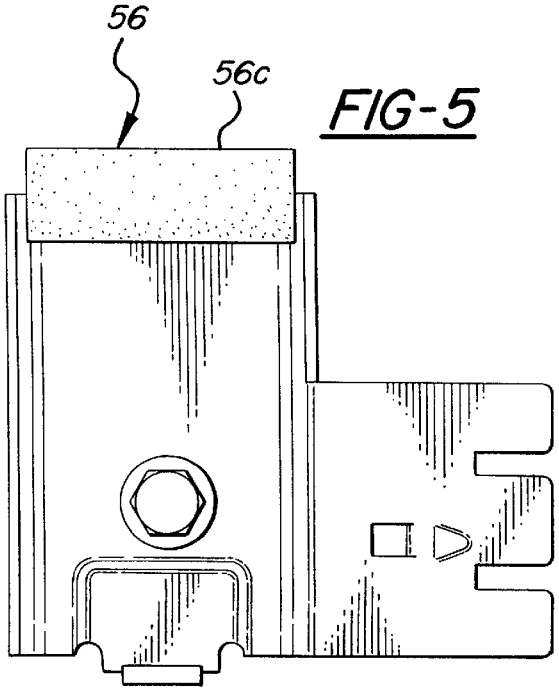
Figure 6:
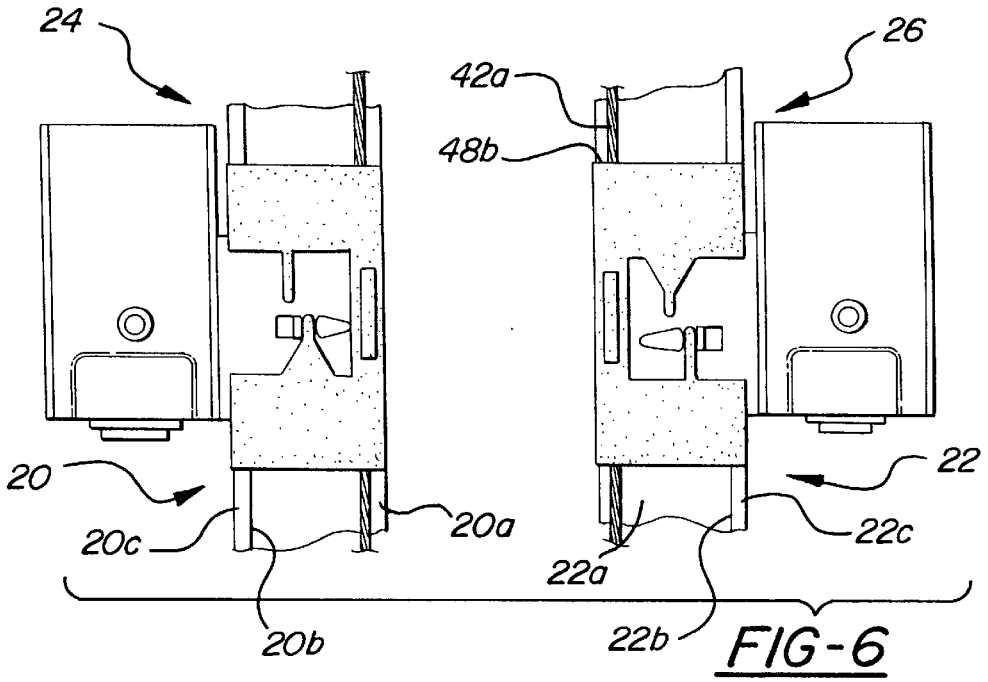
FIG. 6 is a somewhat schematic view showing a comparison of left and right window glass carriers.
Figure 8:
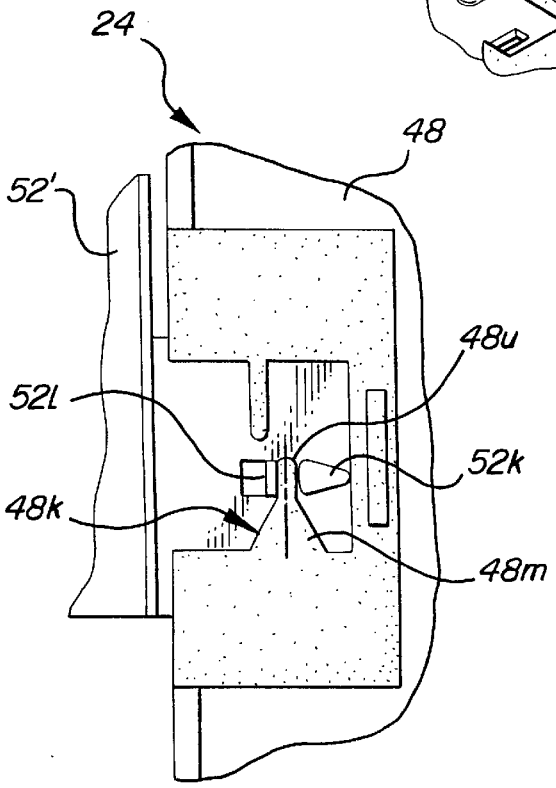

Left window glass carrier 24 is generally similar to right window glass carrier 26. Specifically, the slide 48 of the left window carrier is identical to the slide 48 of the right window carrier, the front clamp 54 is identical to the front clamp of the right window carrier, the liner 56 is identical to the liner 56 of the right window carrier, and the rear clamp 52' of the left window carrier is identical to the rear clamp 52 of the right window carrier except that it is handed with respect to the right window carrier so that the blade 52*d'* extends to the right (FIG. 5) with respect to the main body portion of the clamp rather than to the left as with the rear clamp 52. Clamp 48 of the left window carrier is also rotated 180° (FIGS. 8 and 9) with respect to clamp 48 of the right window carrier so that as blade 52*d'* is inserted into the slot 48*d*, the lock structures 52*i'* and 52*k'* coact with the tip 48*u* of the prong structure 48*k* (FIG. 9) to provide the coupling between the slide and the clamp. Since prong structure 48*k* comprises a relatively inflexible prong structure, the coupling between the slide and clamp of the left window glass carrier is relatively rigid with only an insignificant amount of lateral movement permitted between the slide and the clamp.

Window regulator 10 is typically delivered to a motor vehicle manufacturer as a subassembly package including left and right rails 20 and 22, left and right window glass carriers 24 and 26 mounted on the rails, pulleys 28, 30, 32, and 34 mounted on the rails, motor and drum assembly 36 mounted on rail 20, and cable assemblies 42 and 44 suitably connected to the window glass carriers and suitably routed around the pulleys and around the drum.

At the motor vehicle manufacturer, window regulator 10 is installed in the interior of the vehicle door 12 with the guide rails 20 and 22 rigidly positioned within the door in laterally spaced parallel relation. Following installation of the window regulator within the door, window glass 14 is dropped in place from above with the lower edge 14*c* of the glass positioned in the liners 56 of the left and right window glass carriers and supported on slide stop portions 48*s* whereafter the glass is raised utilizing the window regulator to allow the side edges 14*a* and 14*b* of the glass to seek a proper, true lateral position with respect to the guide rails 16 and 18 whereafter fasteners 58 are suitably tightened to clamp the lower edge of the glass between the front and rear clamps of the clamp assemblies of the window carriers.

In operation, the flexible coupling provided by the right window glass carrier allows the slide of the right window glass carrier to hunt with respect to the slide of the left window glass carrier to allow the regulator to compensate for other than precise parallelism between the left and right rails 20 and 22 while not disturbing the clamping engagement of the left and right clamp assemblies with respect to the glass. Further, the relatively rigid interconnection between the clamp assembly and slide of the left window glass carrier essentially precludes undesired lateral movement of the window glass relative to the guide rails in any position of adjustment of the window glass relative to the guide rails.

The window regulator of the invention will be seen to provide many important advantages. Specifically, inventory requirements are minimized since the same slide, the same liner, and half of the clamp assembly may be used in both the left and right window glass assemblies; the play provided between the slide and clamp of one of the carriers allows the regulator to hunt laterally in compensation for other than precise parallelism between the left and right rails so as to insure smooth upward and downward movement of the window glass within a large range of rail installation tolerances; the snapping interconnection between the slide and carrier of the window glass carriers minimizes manufacturing costs; and, in general, the simple construction of the window glass carriers allows the production of a relatively small and relatively lightweight window regulator.

Whereas a preferred embodiment of the invention has been illustrated and described in detail, it will be apparent that various changes may be made in the disclosed embodiment without departing from the scope or spirit of the invention.

I claim:

1. A window regulator for raising and lowering a window glass of a motor vehicle comprising a vertical rail defining a vertical track, and a glass carrier adapted to receive a lower edge of the window glass and mounted for vertical movement along the track to raise and lower the window glass; characterized in that the regulator includes:

a slide mounted to and moves generally vertical along the track;

a cable secured to the slide;

a drum receiving the cable and operative in coaction with the cable to move the slide vertically along the track;

a U-shaped upwardly opening clamp adapted to clampingly receive the lower edge of the window glass; and coupling means operative in response to generally horizontal movement of the slide relative to the clamp to snappingly couple the slide and the clamp together to form the glass carrier.

2. A window regulator according to claim 1 wherein:

the vertical rail comprises a first vertical rail;

the window regulator further includes a second vertical rail mounted in laterally spaced generally parallel relation to the first vertical rail;

the slide and clamp comprise a first slide and a first clamp defining a first glass carrier;

the window regulator further includes a second glass carrier including a second slide mounted on the second rail and coupled by coupling means to a second clamp; and the coupling means of the first glass carrier is operative to provide a significant amount of lateral movement between the first slide and the first clamp to allow the window regulator to compensate for other than precise parallelism between the first and second rails.

3. A window regulator according to claim 2 wherein:

the coupling means of the second glass carrier is operative to snappingly couple the second slide and the second clamp together with an insignificant amount of lateral movement permitted between the second slide and second clamp.

4. A window regulator raising and lowering a window glass of a motor vehicle comprising:

a verticle rail defining a vertical track;

a slide mounted to and moves generally vertical along the track;

a drum and cable assembly, including a cable secured to the slide, operative to move the slide vertically along the track;

a U-shape upwardly opening clamp adapted to clampingly receive a lower edge of the window glass; and coupling means operative in response to generally horizontal movement of the slide relative to the clamp to snappingly couple the slide and the clamp together to form a glass carrier.

5. A window regulator for raising and lowering a window glass of a motor vehicle comprising a vertical rail defining a vertical track, a glass carrier adapted to receive a lower edge of the window glass and mounted for vertical movement along the track to raise and lower the window glass, and a drum and cable assembly operative to move the glass carrier vertically along the track; characterized in that the glass carrier comprises:

a first slide mounted for sliding movement along the track;

a clamp adapted to clampingly engage a lower edge of the window glass; and coupling means operative in response to lateral movement of the first slide relative to the clamp to snappingly couple the first slide and the clamp together to form the glass carrier;

the vertical rail comprising a first vertical rail;

the window regulator further including a second vertical rail mounted in laterally spaced relation to the first vertical rail;

the glass carrier comprising a first glass carrier including the first slide mounted on the first rail and coupled to a first clamp;

the window regulator further including a second glass carrier including a second slide mounted on the second rail and coupled to a second clamp;

the coupling means of the first glass carrier being operative to provide a significant amount of lateral movement between the first slide and the first clamp to allow the window regulator to compensate for other than precise parallelism between the first and second rails;

the coupling means of the second glass carrier being operative to snappingly couple the second slide and the second clamp together with an insignificant amount of lateral movement permitted between the second slide and second clamp; and each coupling means comprising a vertically extending prong structure on the respective slide and laterally spaced lock structures on the respective clamp operative in response to lateral coupling movement between the respective slide and the respective clamp to trap the prong structure between the lock structures.

6. A window regulator according to claim 5 wherein:

the prong structure of each of said first and second slides comprises a first relatively flexible prong structure;

each of said first and second slides further includes a second relatively inflexible, vertically extending prong structure; and the first relatively flexible prong structure of the first slide coacts with the lock structures on the first clamp to permit the significant amount of lateral movement between the first slide and the first clamp and the second relatively inflexible prong structure of the second slide coacts with the lock structures on the second clamp to provide the insignificant amount of lateral movement between the second slide and the second clamp.

7. A window regulator according to claim 6 wherein the first and second slides are identical and the first and second clamps are oppositely handed.

8. A window regulator according to claim 6 wherein the slides are formed of a plastic material and the clamps are formed of a metallic material.

9. A window regulator for raising and lowering a window glass of a motor vehicle comprising:

a vertical rail defining a vertical track;

a slide mounted for sliding movement along the track;

a drum and cable assembly operative to move the slide vertically along the track;

a clamp adapted to clampingly engage a lower edge of the window glass; and coupling means operative in response to generally horizontal movement of the slide relative to the clamp to snappingly couple the slide and clamp together to form a glass carrier;

the coupling means comprising a vertically extending prong structure on the slide and horizontally spaced lock structures on the clamp operative in response to horizontal coupling movement between the slide and the clamp to trap the prong structure between the lock structures.

10. A window regulator for raising and lowering a window glass of a motor vehicle comprising:

a vertical rail defining a vertical track;

a slide mounted for sliding movement along the track; a drum and cable assembly operative to move the slide vertically along the track;

a clamp adapted to clampingly engage a lower edge of the window glass; and coupling means operative in response to lateral movement of the slide relative to the clamp to snappingly couple the slide and the clamp together to form the glass carrier;

the coupling means comprising a prong structure on the slide and laterally spaced lock structures on the clamp operative in response to lateral coupling movement between the slide and the clamp to trap the prong structure between the lock structures;

the clamp including a laterally extending blade;

the slide including a slot sized to slidably receive the blade in response to lateral coupling movement between the slide and the clamp;

the slide including a side opening in a lateral edge of the slide to receive the leading edge of the blade and further including a front opening in a front face of the slide;

the prong structure extending vertically and in cantilever fashion into the front opening;

the lock structures being provided on a front face of the blade and including a leading lock structure and a trailing lock structure; and the leading lock structure acting in response to lateral sliding movement of the blade into the slot to bias the prong structure forwardly and thereafter allow the prong structure to snap into place between the leading and trailing lock structures.

11. A window regulator according to claim 10 wherein the leading lock structure has a ramp configuration to facilitate forward biasing of the prong structure in response to insertion of a blade into the slot.

12. A window regulator according to claim 11 wherein:

the slide further includes a plurality of vertically spaced laterally extending passages opening into the slot; and a leading edge of a blade defines a plurality of vertically spaced finger portions sized to fit slidably into respective passages in response to insertion of a blade into the slot.

13. A window regulator according to claim 10 wherein:

the front opening of the slot defines a lower edge and an upper edge;

the prong structure comprises a first prong structure, is relatively flexible in a lateral sense, and extends vertically from one of the upper and lower edges, the first prong structure cooperable with the lock structures to permit a significant amount of lateral movement between a coupled slide and the clamp; and the slide further includes a second prong structure which is relatively inflexible in a lateral sense and extends vertically from the other of the upper and lower edges, the second prong structure cooperable with the lock structures to permit an insignificant amount of lateral movement between a coupled slide and the clamp.

* * * * *